United States Patent [19]

Collver

[11] 4,063,210

[45] Dec. 13, 1977

[54] TEMPERATURE INDEPENDENT SEMICONDUCTOR RESISTOR AND METHOD OF MAKING SAME

[75] Inventor: Michael W. Collver, Sterling Heights, Mich.

[73] Assignee: General Motors Corporation, Detroit, Mich.

[21] Appl. No.: 658,846

[22] Filed: Feb. 17, 1976

[51] Int. Cl.[2] ..... H01C 7/02

[52] U.S. Cl. ..... 338/7; 338/308; 427/86; 427/87; 357/64; 357/59; 75/134 S; 75/134 G

[58] Field of Search ..... 338/7, 308; 357/64, 357/59; 75/134 S, 134 G; 427/86, 87

[56] References Cited

U.S. PATENT DOCUMENTS

| | | | |
|---|---|---|---|
| 2,871,427 | 1/1959 | Tyler et al. | 317/239 |
| 3,240,625 | 3/1966 | Collins | 338/308 X |
| 3,248,677 | 4/1966 | Hunter et al. | 338/7 |
| 3,448,350 | 6/1969 | Yamashita et al. | 317/234 |
| 3,725,161 | 4/1973 | Kuper | 75/134 G X |

OTHER PUBLICATIONS

Journal of Applied Physics, 33, No. 12 (Dec. 1962), 3458–3463.

*Primary Examiner*—Benjamin R. Padgett
*Assistant Examiner*—E. Suzanne Parr
*Attorney, Agent, or Firm*—Robert J. Wallace

[57] ABSTRACT

A polycrystalline film having an electrical resistivity independent of temperature is disclosed. The film has substantially only one crystalline phase. The crystals forming that phase are of a semiconductive material supersaturated with a deep level dopant and have average dimensions from about 200 to 10,000 angstroms. At least about 10 atomic percent of the deep level dopant is dispersed within the semiconductive material crystals forming the one crystalline phase. The film is useful in making an electrical resistor whose resistance value is independent of temperature from about 4° Kelvin to approximately 373° Kelvin.Aging effects limit utility at significantly higher temperatures.

6 Claims, No Drawings

TEMPERATURE INDEPENDENT SEMICONDUCTOR RESISTOR AND METHOD OF MAKING SAME

BACKGROUND OF THE INVENTION

This invention relates to a polycrystalline film of a semiconductive material that is supersaturated with a deep level impurity. More specifically, this invention relates to a single phase polycrystalline film of semiconductive material that can be used as a temperature independent electrical resistor.

It is known that a resistor made of a semiconductive material having a shallow lever dopant will have a positive temperature coefficient of resistance over a narrow range of temperature near room temperature. This is due at least in part to a decrease in carrier mobility with increasing temperature within the depletion range of the doped semiconductive material. Accordingly, if uncompensated, a semiconductive resistor will increase in resistance value in this range with increase in temperature.

Considerable effort has been devoted to tailoring the temperature coefficient of resistance for semiconductor resistors. Much of it has been directed to compensating the resistance change, to maintain it substantially stable over a selected temperature range. In general, the tailored semiconductive resistors involve a monocrystalline semiconductive host material containing a shallow level dopant and a deep level dopant. The two dopants are present in selected combinations and relative concentrations to obtain the selected temperature characteristic within a given temperature range. Semiconductor resistors have been produced in which the inherent increase in resistivity is partially and even wholly compensated, or in some instances augmented. In some instances, as for example as disclosed in U.S. Pat. No. 3,292,129 Sanchez et al, a semiconductor host material can be more than compensated. It can be converted into having a negative temperature coefficient of resistance, forming an NTC thermistor. U.S. Pat. No. 3,248,677 Hunter et al discloses including both shallow level and deep lever dopants in a semiconductor host material to obtain more complete temperature compensation over a limited temperature range.

U.S. Pat. No. 3,484,668 Komatsu reports that full compensation cannot actually be obtained. The solid solubility of a deep level impurity in the semiconductive host material limits one from obtaining maximum compensation of mobility decrease with temperature. Consequently another approach is described by Komatsu to get adequate compensation in the selected temperature range. Prior semiconductor resistors require precise moderate concentrations for both the dominant shallow level dopant and the compensating deep level dopant. Moderate levels of doping are difficult to reproduce with accurate precision, particularly on polycrystalline material. This problem is aggravated considerably when two precise dopings are required. Accordingly, yields are lower and costs increased. Costs are also increased if the resistor is made with single crystal material. Lastly, most semiconductor resistors exhibit their selected tailored properties over only a narrow temperature range that only includes some but not all of the range −40° C. to 100° C.

OBJECTS AND SUMMARY OF THE INVENTION

It is a principal object of this invention to provide a polycrystalline material having a single crystalline phase and having crystals which are supersaturated with a deep level dopant in solid solution.

Another object of this invention is to provide a polycrystalline semiconductive resistor having a single crystalline phase with crystals supersaturated with a deep level dopant and having a resistivity that is independent of temperature within a range of 4° Kelvin to 373° Kelvin.

A further object of the invention is to provide a method of making such materials and resistors.

These and other objects of the invention are obtained with a layer of polycrystalline semiconductive material having substantially only one crystalline phase. The crystals forming that phase have the same crystal structure as that of the semiconductive material and are supersaturated with a deep level dopant. The crystals are of a grain size greater than 200 angstroms and contain a deep levcl dopant in supersaturated solid solution.

The semiconductive film of this invention is produced by codepositing the semiconductive material and the deep level dopant in an appropriate preselected atomic ratio onto a heated substrate. The substrate is heated to a temperature particularly selected to produce a film having a single crystalline phase and a grain size of 500 to 10,000 angstroms. A substrate temperature of about 400° - 700° C. is required for silicon and germanium.

DESCRIPTION OF THE PREFERRED EMBODIMENTS

A temperature independent resistor can be formed in accordance with this invention by codepositing a deep level dopant and a semiconductive material on a heated substrate to form a polycrystalline film. The film only has crystals of the semiconductive material, and these crystals are supersaturated with the deep level dopant. Thus there is only one crystalline phase, and the crystals forming that phase are host crystals for the deep level dopant.

By the expression deep level dopant, I mean any conductivity determining impurity, when present in concentrations up to its normal solid solubility, having an activation energy that is about 10% to 90% of the band gap energy for the host semiconductive material. The energies referred to herein are for measurements at room temperature. Silicon has a band gap of 1.1 electron volts. Germanium has a band gap of 0.66 electron volts. Nickel has an activation energy of 0.22 electron volts and cobalt an activation energy of 0.5 electron volts. Both nickel and cobalt are therefore useful as deep level dopants in silicon and germanium. They are also useful as deep level dopants in compound semiconductors, as for example gallium arsenide which has a band gap of 1.43 electron volts. Accordingly, for silicon a conductivity determining impurity having an activation energy of approximately 0.1 to 0.99 electron volts is satisfactory. For germanium a conductivity determining impurity having an activation energy of approximately 0.066 to 0.59 would be satisfactory.

As mentioned, my polycrystalline material contains only one crystalline phase. By this I mean the many small crystals forming my polycrystalline material are all of the same crystal type. This crystal type is that of the host semiconductor material. There are no identifiable crystalline forms of other types, as for example crystals of compounds formed between the deep level dopant and the semiconductor material, or crystals of the deep level dopant itself. This indicates that there is a supersaturated solid solution of the deep level dopant in the crystals forming the polycrystalline layer, without any significant precipitation of the deep level dopant within or on the surfaces of the individual crystal grains. Accordingly, the electrical resistivity of my polycrystalline layer is dictated at least substantially by the electrical characteristics of the individual crystal grains of the one phase, without compensation by crystals of other electrical properties. The host semiconductive material need only be of the usual purity for semiconductive applications, as for example, usually greater than about 0.01 ohm-cm resistivity.

Nickel and silicon can be codeposited to make a temperature independent resistor in accordance with this invention. To make the deposition, quartz or alumina substrates are placed in an evaporation chamber of a multiple source evaporation apparatus having a substrate heater. The substrate is placed on its holder in the chamber. One source is loaded with nickel having a purity of 99.99%. Another source is loaded with undoped silicon having a resistivity of at least about 0.01 ohm-cm. The evacuation chamber is then closed, and evacuated to a pressure of about $1 \times 10^{-7}$ torr. The substrate is subsequently or concurrently heated to a temperature of 700° - 800° Kelvin. The substrate is disposed about 15 centimeters from the evaporation sources, which are spaced about 15 centimeters apart. After the substrate temperature and chamber pressure have been stabilized, evaporation from both sources is simultaneously started.

If desired, the polycrystalline film can be deposited through a mask to provide specific resistor delineation during the deposition process. On the other hand, it may be desired to make a blanket deposition and more specifically define the resistor pattern later by photoetching or other techniques.

If resistor delineation by means of a mask in the evacuation chamber is to be used, the mask is moved into place over the heated substrate before deposition of the nickel and polycrystalline film is begun. It may be preferred to evaporate the polycrystalline film through a mask if a deposition mask is to be used for producing electrode contacts on the resistor film. In such instance both the film and the electrodes can be produced in the same evacuation chamber in immediately successive steps without an intervening exposure to room atmosphere.

Evaporation is controlled to simultaneously evaporate the nickel and silicon atoms at a relative rate slightly greater than about 1:9, respectively. Electron beam evaporation apparatus is particularly suitable for this type of deposition. Evaporation of both the nickel and silicon can be monitored continuously and controlled to obtain precise evaporation rates which are desired. The evaporation rate from each source can be sensed to control the rate of evaporation by means of a feedback loop to the electron beam power source control. An ionization gauge type monitor or quartz crystal oscillator can be used to sense the rate of evaporation.

In this example it is desired to produce a thin film coating containing approximately 12 to 14 atomic percent nickel. Accordingly, the power supply and controls are adjusted to produce an appropriate relative evaporation rate. A combined evaporation rate, i.e., from both sources, which will deposit the film at about 50 angstroms per second has been found to be satisfactory. However, any evaporation rate that will produce silicon crystals of about 200 - 10,000 angstroms, preferably 1,000 angstroms, can be used. In most instances a rate of evaporation of about a few angstroms per second to about 200 angstroms per second can be used. In this example, evaporation is continued at a combined rate of 50 angstroms per second for approximately 5 minutes, to produce a total film thickness of about 1.5 microns (15,000 angstroms). However, film thickness is not more critical to this invention than it is to any other thin film coating as long as it exceeds several hundred angstroms. By thin film, I mean less than 1 mil thick.

On the other hand, it is highly important that the substrate be maintained at a preselected temperature which will produce crystals of the desired grain size. A temperature range of about 400° - 700° C. is satisfactory for silicon and germanium. This range may be useful for many other host semiconductive materials too. If the deposition temperature is too low an amorphous semiconductive film may result. An amorphous film is of no practical value in this invention since it is susceptible to changing its resistance during use. The amorphous film is highly water absorbent. It is more susceptible to oxidation than polycrystalline material. It has more open spaces, such as microvoids and the like, than polycrystalline material. Hence, it is difficult to reproduce the original characteristics of the amorphous material. The amorphous material is more likely to exhibit annealing effects because the diffusion coefficient of the deep level dopant is much greater in an amorphous material than in a crystalline material. The likelihood of nickel segregating during use is greatly magnified in an amorphous material as compared to a crystalline material. In addition, analogous problems may occur if the material is polycrystalline but the grain size is too small, as for example below about 500 angstroms. In such instance, the deep level dopants have a greater likelihood of migrating to grain boundaries and precipitating out of solid solution, permanently changing the resistance value of the resistor. Below 200 angstroms grain size, this effect is considerably more likely. Larger crystals are not objectionable. However, obtaining a uniform mixture of such crystals in very large size by this technique may at times prove to be difficult.

Spaced electrodes can be provided on my film to provide electrodes to which external leads can be connected. If desired, the electrodes can be of evaporated aluminum, from a third source in the same evacuation chamber, and applied at the same chamber pressure and substrate temperature. Aluminum deposition can be done though a mask in the evacuation chamber, or by blanket diffusion followed by photoetching. If a mask is used during the aluminum deposition, it is moved into position over the substrate after deposition of my polycrystalline silicon film. The aluminum evaporation is then commenced, and continued until a continuous aluminum film is formed. A thickness of approximately 2,000 angstroms can be used. The aluminum deposition and substrate heating is then discontinued. The chamber pressure is then brought back up to atmospheric pressure after the subtrate cools to room temperature, the chamber opened, and the substrate removed.

Temperature independent resistivity is achieved at the metal-semiconductor transition concentration. The precise concentrations at which this occurs may differ from one host semiconductive material to another, and from one dopant to another. Acceptable temperature independent resistors can be obtained at concentrations about 1 atomic percent above and below the metal-semiconductor transition temperature. For nickel in silicon, this would be a range of about 11 – 13 atomic percent nickel in silicon. It is expected that in most instances at least about 10 atomic percent of the deep level dopant is required to approach the metal-semiconductor transition concentration and produce temperature independence. However, it is recognized that there may be certain selected combinations of semiconductive material hosts and deep level dopants in which a lower concentration of the deep level dopant produces temperature independence. Correspondingly, certain selected combinations of semiconductive material hosts and deep level dopants may in fact require a higher concentration of the deep level dopant to produce temperature independence. As for example about 12 atomic percent nickel or about 14 atomic percent cobalt is needed in silicon to produce complete temperature independence. If complete temperature independence is not required, a lesser concentration of the dopant in supersaturated solid solution can be used. In such instance a negative temperature coefficient of electrical resistance will result. This characteristic will exist over a wide temperature range.

Concentrations of the deep level dopant in excess of that which can be retained in supersaturated solid solution even by my method of formation are to be avoided. Such concentrations can readily introduce a second crystalline phase, i.e. precipitated deep level dopant, into my material. This is objectionable because it adversely affects resistance and temperature independence. As mentioned in connection with minimum concentration, it is expected that the maximum permissible concentration of the deep level dopant will depend upon the particular semiconductor host material and the particular deep level dopant used in that selected semiconductor host material. However, in general, it would appear that concentrations greater than about 18 to 20 atomic percent of the deep level dopant are to be avoided in most host semiconductive materials. In some instances, the higher concentration of deep level dopant may even produce a positive coefficient of electrical resistance before a concentration is reached that will produce precipitation at grain boundaries. The positive coefficient of electrical resistance may be useful in some applications because of the wide temperature range over which it extends. Analogously, it is contemplated that my material may even prove to be useful with the host semiconductive material containing shallow level dopant in solid solution.

In general I prefer to use a concentration of the deep level dopant large enough to produce a temperature independent electrical resistance characteristic, but which is not so large as to produce a positive coefficient of electrical resistance or a measurable second crystalline phase. By measurable I mean a crystalline phase which is detectable by current x-ray diffraction or electron diffraction analysis techniques.

I have described may material as being formed by co-evaporation of the deep level dopant and the semiconductive host material. The electron beam evaporation process herein-before described is not the only technique by which such a material can be produced. Multiple source evaporation by resistance techniques can be used as wel as sputtering. In essence, any vacuum deposition techniques by which the deep level dopant and the semiconductive host material can be simultaneously codeposited would be useful. The only requirement is that the codeposition be performed on a heated substrate, and the deep level dopant and the semiconductive host material be codeposited in the hereinbefore described proportions.

Since my new material is a polycrystalline material, it can be deposited on virtually any substrate. Of course the substrate should have a surface smoothness commensurate with that normally acceptable for any thin film deposition. The substrate material therefore does not have to have a crystal morphology identical to that of the host material. Accordingly, any substrate material which is satisfactory for other considerations can be used. In general I prefer to use quartz or alumina as the substrate. However, my new materials can also be deposited, for example, on a silicon dioxide layer overlying a silicon wafer.

I claim:

1. A semiconductive film comprising, a layer of polycrystalline semiconductive material having substantially only one crystalline phase, with crystals forming that phase being supersaturated with a deep level dopant and having a grain size greater than 200 angstroms.

2. A semiconductive film that has an electrical resistivity of substantially constant characteristics throughout a temperature range of about 4° – 373° Kelvin, said film comprising a layer of polycrystalline semiconductive material having substantially only one crystalline phase, with crystals forming that phase having a grain size of about 500 – 10,000 angstroms and being supersaturated with a dopant having an activation energy, when at room temperature and at concentrations below its normal limit of solid solubility in said semiconductive material, greater than about 0.1 electron volt.

3. An electrical resistor that is substantially constant in its resistance throughout a temperature range of about 4° – 373° Kelvin, said resistor comprising:

a substrate having a surface;

a layer of polycrystalline semiconductive material selected from the group consisting of silicon and germanium on said surface, said layer having substantially only one crystalline phase and the crystals forming that phase having a grain size of about 500 – 10,000 angstroms; 'atoms of a deep level dopant dispersed in supersaturated solid solution within said crystals in a concentration within about 10 – 18 atomic percent and being within about 1 atomic percent of a metal-semiconductor transition concentration with respect to electrical characteristics;

said deep level dopant having an activation energy greater than about 0.1 electron volt, when at room temperature and at concentrations below its normal limit of solid solubility in said semiconductive material; and means for passing electrical current though said layer.

4. An electrical resistors that is substantially constant in resistance throughout a temperature range of about 4° – 373° Kelvin, said resistor comprising:

a substrate having a surface;

a layer of polycrystalline semiconductive material selected from the group consisting of silicon and germanium on said surface, said layer having substantially only one crystalline phase and the crystals forming that phase being greater than 200 angstroms and having an average dimension of the order of 1,000 angstroms;

atoms of a deep level dopant selected from the group consisting of nickel and cobalt dispersed in supersaturated solution within said crystals in a concentration of about 12 - 14 atomic percent; and means for passing electrical current through said layer.

5. A method of making a semiconductor resistive film having electrical resistance characteristics constant over a temperature range of about 4° - 373° Kelvin, said resistive film comprising, heating a substrate to a temperature of about 400° - 700° C. in an evacuated chamber, and simultaneously vacuum depositing onto said heated substrate a semiconductive material and deep level dopant at relative rates that will produce a single phase polycrystalline layer having crystals of semiconductive material greater than 200 angstroms and supersaturated with said deep level dopant.

6. A method of making a resistor having electrical resistance characteristics constant over a temperature range of about 4° - 373+ Kelvin, said resistor comprising, heating a substrate to a temperature of about 400° - 700° C. in an evacuated chamber, and simultaneously vacuum codepositing onto said heated substrate a semiconductive material selected from the group consisting of germanium and silicon and a deep level dopant selected from the group consisting of nickel and cobalt, said semiconductive material and deep level dopant being deposited in an atomic ratio of about 9:1, respectively, and producing a polycrystalline layer having only one crystalline phase, with crystals forming that phase having a deep level dopant dispersed throughout in a concentration of about 10 - 14 atomic percent and said crystals having a grain size of about 500 - 10,000 angstroms.

* * * * *